United States Patent [19]

Jacobs et al.

[11] 4,324,292

[45] Apr. 13, 1982

[54] PROCESS FOR RECOVERING PRODUCTS FROM OIL SHALE

[75] Inventors: Harold R. Jacobs; Kent S. Udell, both of Salt Lake City, Utah

[73] Assignee: University of Utah, Salt Lake City, Utah

[21] Appl. No.: 170,202

[22] Filed: Jul. 18, 1980

Related U.S. Application Data

[63] Continuation of Ser. No. 13,106, Feb. 21, 1979, abandoned.

[51] Int. Cl.[3] ..... E21B 43/243

[52] U.S. Cl. ..... 166/261; 166/259; 208/11 R

[58] Field of Search ..... 166/256, 259, 261; 208/11 R; 299/2

[56] References Cited

U.S. PATENT DOCUMENTS

| | | | |
|---|---|---|---|
| 1,509,667 | 9/1924 | Catlin | 208/11 R |
| 2,796,390 | 6/1957 | Elliott | 208/11 R |
| 2,798,032 | 7/1957 | Martin | 208/11 R X |
| 3,130,132 | 4/1964 | Sanders | 208/11 R X |
| 3,233,668 | 2/1966 | Hamilton et al. | 166/259 |
| 3,291,215 | 12/1966 | Nichols | 166/259 |
| 3,342,257 | 9/1967 | Jacobs et al. | 166/259 UX |
| 3,454,958 | 7/1969 | Parker | 166/256 |
| 3,490,529 | 1/1970 | Parker | 166/256 |
| 3,521,709 | 7/1970 | Needham | 166/259 X |
| 4,036,299 | 7/1977 | Cha et al. | 166/261 |
| 4,097,360 | 1/1978 | Sack | 208/11 R X |

*Primary Examiner*—Stephen J. Novosad
*Assistant Examiner*—George A. Suchfield
*Attorney, Agent, or Firm*—H. Ross Workman; J. Winslow Young; Allen R. Jensen

[57] ABSTRACT

A process for recovering hydrocarbon products from a body of fragmented or rubblized oil shale. The process includes initiating a combustion zone adjacent the lower end of a body of oil shale and using the thermal energy therefrom for volatilizing the shale oil from the oil shale above the combustion front. Improved recovery of hydrocarbon products is realized by refluxing the heavier fractions in the volatilized shale oil. The heavier fractions are refluxed by condensing the heavier fractions and allowing the resulting condensate to flow downwardly toward the combustion front. Thermal energy from the combustion zone cracks the condensate producing additional lower molecular weight fractions and a carbonaceous residue. The carbonaceous residue is burned in the combustion front to supply the thermal energy. The temperature of the combustion front is maintained by regulating input of oxygen to the combustion zone. The process also includes sweeping the volatilized products from the rubblized oil shale with a noncombustible gas. The flow rate of sweep gas is also controlled to regulate the temperature of the combustion front. The recovered products can be enriched with hydrogen by using water vapor as part of the noncombustible sweep gas and cracking the water vapor with the hot carbon in the combustion front to produce hydrogen and an oxide of carbon.

18 Claims, 1 Drawing Figure

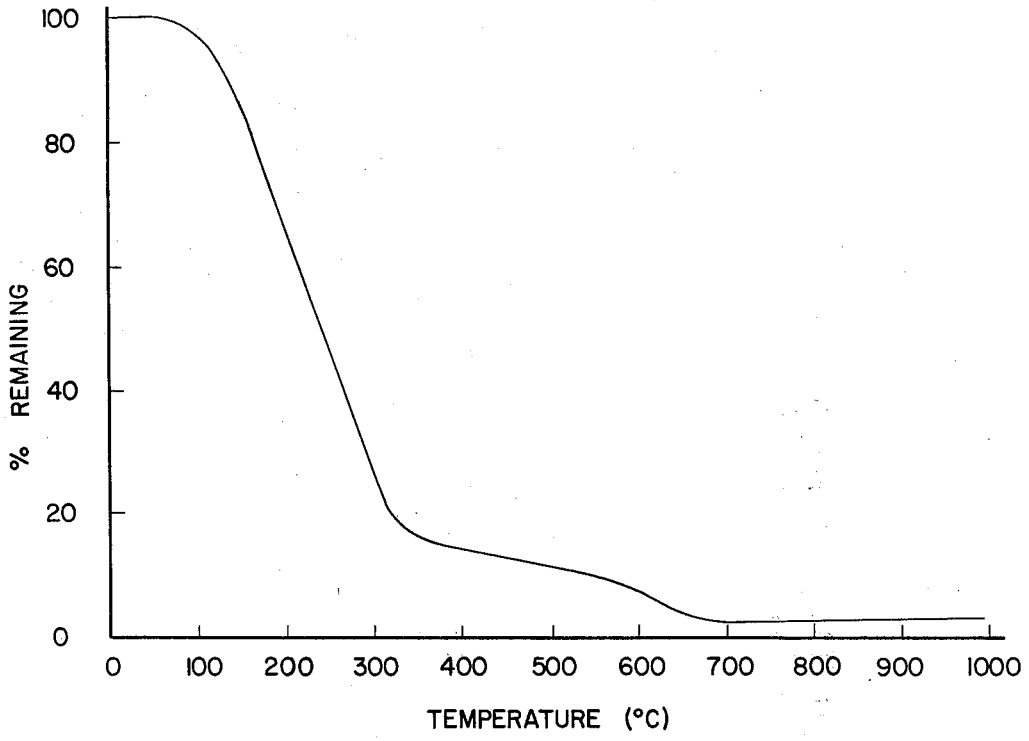
100
80
60
40
20
0
% REMAINING
0
100
200
300
400
500
600
700
800
900
1000
TEMPERATURE (°C)

PROCESS FOR RECOVERING PRODUCTS FROM OIL SHALE

This is a continuation of application Ser. No. 013,106, filed Feb. 21, 1979, now abandoned.

BACKGROUND

1. Field of the Invention

This invention relates to a thermal process for recovering products from oil shale and, more particularly, to a novel process for improving production of lower molecular weight products from oil shale by volatilizing the shale oil and refluxing a portion of the higher molecular weight fractions.

2. The Prior Art

Oil shale is defined as a fine-grained, sedimentary rock having splintery, uneven fractures and including an organic material generally referred to as kerogen. Kerogen is a ruberoid material with a ratio somewhat higher than conventional petroleum. Shale oil is produced from oil shale be destructive distillation of the kerogen, normally by thermal means. Oil from oil shale deposits within the United States alone constitutes a potential energy resource of about 27 trillion barrels (nearly triple the equivalent energy contained in the domestic coal reserves or 130 times the crude oil production resource of the United States). For example, the oil shale lying within the Green River Formation (located in the states of Utah, Colorado and Wyoming) is of sufficient yield and accessibility to be considered recoverable within the realm of present technology and is estimated to be as high as 760 billion barrels. When considered in light of the present economics and the fact that the current technology restricts the recovery of this vast resource only to those relatively shallow, thick veins of high grade oil shale located within the region, this represents a valuable resource. If effective processing of lower grade shale can be realized, the magnitude of this resource may double.

A number of processes have been developed to extract shale oil from shale by retort processes which usually involved heating the raw oil shale and recovering the volatilized products. Thus, the retort processes involve equipment that basically consists of a heat source and a heat exchanger. The heat source is primarily obtained by burning combustible components of the shale oil. These combustible components include: (1) the light gaseous hydrocarbons evolved during the retorting process, (2) the shale oil itself, and (3) the carbon residue left in the inorganic shale matrix after heating and the volatilization of shale oil has been completed. Oil shale retort processes can be classified as either above ground or in situ (underground) processes. While above ground processing appears attractive in terms of efficiency and utilization of available technology, in situ retorting has the obvious advantage of lower mining costs and the elimination of the problem of spent shale disposal.

One in situ retorting process has been tested wherein hot methane was injected into a naturally permeable, leached oil shale formation. This process produced a low pour point oil. However, due to the loss of the injection gas (methane) into the unconfined fracture pattern, this method of recovery proved to be too costly. Super-heated steam is currently being considered as an alternative injection gas to the hot methane. However, the results are not yet available as to the long range economics of the process particularly as to water loss and energy required to produce the steam.

Another process demonstrated on a commercial scale involved the initial mining of a predetermined volume of oil shale from the top section of an underground body of oil shale. Explosives were then used to rubblize the oil shale body to produce a packed bed column of known void fraction and particle size. A combustion zone was then established at the top of the rubblized column. Combustion of residual carbon in the shale was maintained by the continued injection of air, partially diluted with recycled off gas. The necessary retort heat was provided by the combustion front which moved downwardly through the rubblized oil shale bed heating the raw oil shale directly beneath. The shale oil, initially in vapor form, condensed on the raw shale and drained to the bottom where it was removed. Although this process involved substantial mining and, therefore, was more expensive than a true in situ process, the mining costs were relatively less than any above ground processing. Additionally, spent shale disposal was avoided since the processed shale remained underground.

While it has been demonstrated that shale oil can be produced in commercial quantities with several different processes, the primary obstacle in the path of ultimate large scale utilization of shale oil remains in the fact that shale oil is of a different chemical composition than the average petroleum crude oil. In particular, shale oil contains up to 2% nitrogen (the average for petroleum crude being less than 0.9% nitrogen). Nitrogen tends to form oxides of nitrogen when the product is burned with air so that the use of shale oil as a boiler fuel may face difficult pollution constraints. Nitrogen also acts as a catalyst poison in conventional refineries.

Shale oil also contains a larger percent of residual fractions than conventional crudes. Residual fractions in shale oil are of normally low economic value, so that the market value of shale oil is expected to be less than standard crude oil.

While the first problem, that of high nitrogen content, can be solved by utilizing special denitrification techniques, the solution to the problem of high residual fractions in the shale oil presents a problem which is not overcome in any of the existing retort processes.

In view of the foregoing, it would be an advancement in the art to provide an improved process for recovering products from oil shale. It would also be an advancement in the art to provide a process whereby high residual fractions in shale oil are reduced during the retort process. It would also be an advancement in the art to provide a process for recovering shale oil wherein the off gas recovered therefrom is enriched with hydrogen. Such a process is disclosed and claimed herein.

BRIEF SUMMARY AND OBJECTS OF THE INVENTION

The present invention relates to a novel process for retorting oil shale whereby a combustion front is initiated adjacent the lower end of a bed of rubblized oil shale. The residual fractions in the volatilized shale oil are refluxed by being condensed on unprocessed shale and cracked to produce lower molecular weight fractions and a carbonaceous residue on the spent shale. This carbonaceous residue serves as an increased source of fuel for sustaining the combustion process. Thus, processing of lower grade oil shale is possible when the present invention is used.

The temperature of the combustion front is selectively controlled by regulating the amount of oxygen injected therein. The temperature of the combustion front may also be regulated, in part, by sweeping the bed with any noncombustible gas introduced with the oxygen. Enrichment of the recovered product is accomplished by injecting water vapor into the combustion zone so that the residual carbonaceous residue cracks the water vapor to form hydrogen and an oxide of carbon.

It is, therefore, a primary object of this invention to provide improvements in the process for recovering products from oil shale.

Another object of this invention is to provide an improved process for recovering products from oil shale in situ.

Another object of this invention is to provide an improved process for refluxing a portion of the higher molecular weight fractions in the shale oil to produce additional lower molecular weight fractions.

Another object of this invention is to provide a novel process for recovering a higher percentage of lower molecular weight fractions from shale oil.

Another object of this invention is to provide a process for enriching the products recovered from an oil shale with hydrogen. Another object of this invention is to provide an efficient process for recovering products from lower grade shales.

These and other objects and features of the present invention will become more fully apparent from the following description and appended claims taken in conjunction with the accompanying drawing.

BRIEF DESCRIPTION OF THE DRAWING

The drawing is a distillate weight loss curve showing percentages of shale oil remaining in the oil shale plotted against temperature.

DETAILED DESCRIPTION OF THE PREFERRED EMBODIMENTS

The invention is best understood by reference to the drawing in combination with the accompanying text.

General Discussion

The present invention relates to a novel process for recovering shale oil from a bed of oil shale wherein a combustion zone is created adjacent the lower end of a rubblized bed of oil shale. Oxygen is regulated and injected into the combustion zone to maintain the temperature of the upwardly moving combustion front. The thermal energy from the combustion front volatilizes shale oil and kerogen in advance of the combustion front. The lower molecular weight fractions are drawn off and recovered while the higher molecular weight fractions are condensed on the cooler, raw shale above the combustion zone. The condensate drains downwardly toward the high temperature region of the combustion front and is refluxed by being either revaporized or cracked by being exposed to combustion zone temperatures which may be well above 1200° C. The net result is that the cracked condensate provides a carbonaceous residue and additional quantities of lower molecular weight fractions which are recovered.

The raw oil shale in advance of the upwardly moving combustion front is heated by thermal energy transferred from the hot gasses flowing through the combustion front and by the heat of vaporization released upon condensation of the higher molecular weight fractions. This heating of the raw oil shale produces a breakdown of kerogen in the body of oil shale in advance of the combustion front.

Since the injection of pure oxygen would result in excessive temperatures, a noncombustible gas is swept through the bed to assist in removing the volatilized products and in maintaining the temperature of the combustion front by diluting the oxygen. Combustion products recovered from the off gas stream may be used as a portion of the noncombustible sweep gas. Water vapor may also be used as the noncombustible gas with the additional advantage of enriching the products with hydrogen. In particular, water vapor is cracked upon contact with the hot, carbonaceous residue as is well known in the art producing hydrogen and an oxide of carbon (carbon monoxide or carbon dioxide). Water vapor also provides the additional advantage that when used as a sweep gas any uncracked water vapor can be condensed to provide a simple process for limited product enrichment.

While the experimental procedures used to demonstrate the validity of this novel process were carried out in an above-ground vessel, the existing technology for establishing an in situ process is sufficiently well known such that the teachings of the present invention can be incorporated readily into an in situ process. This is particularly advantageous since none of the prior art processes either disclose or suggest a bottom burn retort process with internal reflux.

Experimental Procedure

Experimentally, the process of this invention was demonstrated in a laboratory model retort vessel wherein a packed bed of oil shale was supported on a steel grate and ignited at the lower end of the bed with a combustible mixture. After ignition, no further combustible gasses were injected. Temperature of the combustion front was maintained by regulating the volume of oxygen introduced in the inlet air while also diluting the inlet air with an inert gas such as nitrogen.

Crushed oil shale was obtained from the Parachute Creek region of the Green River Formation and was screened and sorted according to size. For these experiments, only the oil shale pieces which would pass through a 3.8 cm screen but not a 1.9 cm screen were used. The shale was carefully packed into the retort vessel to obtain a uniform packing and to guard against damage to thermocouples therein. From known density, volume and oil shale weight, the void fraction was then calculated. Since the density of the individual samples varied, an average density was obtained for each batch of oil shale used in a particular experimental run. Using the average density, the average oil yield was obtained by correlating density with oil yield. It was found that there was very little variation in the average shale grade used in these experiments and that the average grade was approximately 33 gal/ton (137.7 l/tonne).

Shale oil samples obtained from the experimental combustion retort of this invention were evaluated in terms of distillate distribution, specific gravity, elemental composition, and pour point. A thermogravimetric analysis (TGA) of each sample was obtained in order to determine the oil weight loss as a function of temperature. The relationship of oil weight loss as a function of temperature for a typical sample is illustrated in the drawing. With particular reference to the drawing, two points are of particular interest. First, nearly 85% of the original sample has been distilled at a temperature of 350° C. or below. Since this weight loss correlates closely to a volumetric loss, it is easily seen that the oil sample is primarily composed of a light distillate. Second, there is a substantial increase in the weight loss rate at temperatures approaching 600° C. This rate change can be attributed to the thermal cracking of the residual fractions, the cracking being substantially complete above about 700° C. in an oxidizing atmosphere. All but 40 percent of the residual left above 700° C. was oxidized in a separate TGA conducted in an oxidizing environment indicating a relatively high percentage of carbonaceous residue.

The TGA data obtained from the heating of the oil samples was converted from weight to volumetric loss percentages, thus producing a close approximation to ASTM distillate curves. For the experiments conducted according to the process of this invention, there was little variation in the individual oil sample properties and, therefore, average values of the distillate fractions, specific gravity, elemental composition, and pour point are representative of the oil produced. These properties for the representative bottom-fired shale oil retort process are listed and compared to published data for shale oil produced in prior art top-fired combustion processes. The results are tabulated in Table 1, below. It should be noted that the distillation procedures and reported cut points for shale oils produced from the prior art processes vary and thus the distillate fractions listed for these processes may be subject to some error. However, it is believed that they are not more than five percent in error.

TABLE I

Comparison of Shale Oil Properties

| | Present Invention | Process A | Process B | Process C |
|---|---|---|---|---|
| OIL PROPERTIES | | | | |
| Gravity (°API) | 31.7 | 25.2 | 25 | 21.2 |
| Specific Gravity | .867 | .903 | .904 | .927 |
| Pour Point °C. | 20 | 21 | 21 | 29 |
| Weight % C | 84.14 | 84.58 | 84.86 | — |
| Weight % H | 11.88 | 11.76 | 11.80 | — |
| Weight % N | 2.06 | 1.77 | 1.5 | 2.11 |
| C/H Ratio | 7.08 | 7.19 | 7.17 | — |
| DISTILLATION (Vol. %) | | | | |
| Naptha IBP to 204° C. | 40.1 | 6.5 | 4.6 | 6 |
| Light distillate 204° C. to 316° C. | 44.9 | 30.9 | 25.4 | 16 |
| Light gas oil 316° C. to 427° C. | 4.6 | 35.6 | 45.0 | 30 |
| Heavy gas oil 427° C. to 538° C. | 1.8 | 20.4 | 20.0 | 30 |
| Residuum over 538° C. | 8.6 | 6.6 | 5.0 | 18 |
| % Fisher Assay | 65 | 62 | 60 | 86.2 |

It can be seen from Table 1, above, that oil from the bottom-fired retort is much lighter than oil obtain from any other combustion retort process. Of particular interest is the comparison of the oil produced in the bottom-fired retort of this invention with the bottom-fired gas combustion retort product (Process C). Since the Process C retort can be considered a bottom-fired retort, it might be expected that the oil produced thereby would exhibit substantially the same characteristics as oil produced from the bottom-burn retort of this invention. This was not the case because of one major difference: The oil vapors in the Process C gas combustion retort are swept from the continuous fed oil shale bed before condensation of any oil on the raw shale is experienced. Therefore, unlike the bottom-burn retort of this invention there is no mechanism for internal refluxing and thus no thermal cracking of the higher molecular weight fractions. This lack of internal refluxing is also inherent in the other prior art devices.

Although the oil produced from the experimental bottom-burn retort of this invention has a relatively high API gravity, it also has a high pour point. Since most crude oils of the high API gravity will have low pour points, the pour point of this shale oil seemed incongruent with expected results. This anomalous behavior of shale oil is a result of a high nitrogen and paraffin content. Extensive mass spectrometric and liquid chromatographic analyses are currently being conducted in order to more thoroughly understand the major constituents of the oil produced by this invention. A preliminary gas chromatographic analysis has shown that only about 40% of the oil is composed of chromatographable hydrocarbons with the remaining 60% composed of species which account for a very broad peak that covers the entire chromatogram. This is believed to be compounds of nitrogen containing polymerized hydrocarbons.

While the primary drawback in the utilization of a bottom-burn combustion retort is reduced oil yield, it is important to consider that the fraction of oil lost by this process is generally part of the heavy distillate or residual oils. This distillate is condensed on the surface of retorted oil shale particle as the combustion zone approached that location. As this distillate fraction was exposed to the high combustion temperatures, the heavy oil was converted to a lighter oil and a carbonaceous residue or coke. The oil data indicates that most of the lighter oil was recovered. Therefore, the lost oil fraction was utilized as fuel in the form of residual carbon.

Further evidence of the internal refluxing and thermal cracking is demonstrated by chromatographic analysis of the recovered off gas. Composition of the off gas produced in one experimental run is shown in Table 2, below.

The increase of gaseous hydrocarbon production shown in Table 2 represents the result of an increase in the rate of thermal cracking within the retort vessel. For example, at only 3.5 hours into the particular experiment, there was not a sufficient quantity of oil condensed in the packed shale bed to facilitate draining downward toward the combustion zone. However, this was not the case after five additional hours of retorting. Also of interest is the simultaneous increase in the percentage of carbon monoxide and carbon dioxide and the decrease in oxygen. Since the oxidation of the residual carbon in a spent piece of oil shale is an oxygen diffusion-controlled process, conversion of the carbon char to carbon monoxide or carbon dioxide is dependent on the location or depth of that carbon inside the shale particle itself. A result of the thermal cracking of the oil is the deposition of carbon on the surface of the spent shale particles with a corresponding increase in the oxidation rate of carbon as was observed.

The combustion front propagation velocities in various experiments were found to be nearly constant and equal. The measured velocity for each experiment was approximately 11.5 cm/hr.

TABLE 2

| | Off Gas Composition of Sample Run | |
|---|---|---|
| | 3.5 Hours After Ignition | 8.5 Hours After Ignition |
| $N_2$ | 73.5% | 70.1 |
| $O_2$ | 4.8* | 2.1* |
| CO | 1.6 | 3.7 |
| $CO_2$ | 10.8 | 15.4 |
| $H_2O$ | 2.9 | 2.9 |
| Methane | 1320 ppm | 1650 |
| Ethene | 330 | 250 |
| Ethane | 790 | 930 |
| Propene | 480 | 470 |
| Propane | 540 | 640 |
| Butenes | 440 | 440 |
| Butane | 440 | 530 |
| Pentenes | 320 | 350 |
| Pentane | 520 | 590 |
| | 5.9% unaccounted for | 5.2% unaccounted for |

*Unresolved from Argon

Since a steady combustion wave could not be established in one experiment due to a low inlet gas oxygen/nitrogen ratio (1:1) a propagation velocity could not be obtained. The difference in inlet gas oxygen content had little effect on the combustion zone propagation rate when sufficient temperatures to sustain combustion were obtained; but it strongly affects the ability to burn when inadequate temperatures result. The difference in peak temperatures between inlet gas air/nitrogen ratios of 1.68 and 1.5 was approximately 80° C.

In summary, the product oil from a bottom-burning combustion retort of this invention is of higher API gravity and lighter distillate than other comparable combustion retort processes. Internal refluxing converts a substantial portion of the heavy distillate into light oils and a coke residue with the presence of coke altering the heat transfer and combustion processes. While air/nitrogen ratios have little affect on the combustion zone propagation ratios, they do effect combustion zone peak temperatures. The inclusion of water/vapor in the injection air enriches the product stream with hydrogen.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed and desired to be secured by a United States Letters Patent is:

1. A process for recovering hydrocarbonaceous products from a body of fragmented oil shale in situ, comprising:

volatilizing hydrocarbonaceous products from the body of fragmented oil shale by forming in situ a combustion front in the oil shale adjacent the lower end of the body of fragmented oil shale, the thermal energy from said combustion front producing a body of hot shale, a first lower molecular weight fraction and a higher molecular weight fraction;

refluxing the higher molecular weight fraction by condensing said higher molecular weight fraction on oil shale above said combustion front forming a condensate and flowing said condensate downwardly into contact with said body of hot shale;

producing a carbonaceous residue on said body of hot shale by cracking said condensate on said body of hot shale while producing a second lower molecular weight fraction and said carbonaceous residue, the second lower molecular weight fraction volatilizing and passing upwardly through said body of fragmented oil shale;

burning said carbonaceous residue, thereby continuously forming said combustion front and advancing said combustion front upwardly through said body of fragmented oil shale; and sweeping said first and second lower molecular weight fractions from said body of fragmented oil shale by passing a noncombustible gas upwardly through said body of fragmented oil shale so as to sweep away said first and second lower molecular weight fractions while allowing condensation and downward flow of said higher molecular weight fraction in said refluxing step.

2. The process defined in claim 1 wherein the volatilizing step further comprises controlling the temperature of the combustion front by regulating the amount of oxygen available to the combustion front.

3. The process defined in claim 1 wherein the sweeping step further comprises recycling at least a portion of combustion products from said combustion front as the noncombustible gas.

4. The process defined in claim 1 wherein said sweeping step comprises passing water vapor upwardly through said body of fragmented oil shale as a portion of said noncombustible gas.

5. The process defined in claim 4 wherein the passing step further comprises enriching the hydrocarbonaceous products with hydrogen by cracking at least a portion of the water vapor with the carbonaceous residue in the combustion front thereby producing hydrogen and an oxide of carbon.

6. The process defined in claim 4 wherein the passing step further comprises concentrating the first and second lower molecular weight fractions by condensing water vapor after said recovering step.

7. The process defined in claim 1 wherein the sweeping step further comprises diluting oxygen to the combustion front with the noncombustible gas thereby further controlling the temperature of the combustion front.

8. The process defined in claim 1 wherein the cracking step further comprises preheating the body of fragmented oil shale above the combustion front with the first and second lower molecular weight fractions and the condensing of the higher molecular weight fraction thereby producing a thermal breakdown of kerogen in the body of fragmented oil shale in advance of the combustion front.

9. A process for producing a volatilized, hydrocarbonaceous product from a body of rubblized oil shale in situ, comprising:

forming an upwardly traveling combustion front in the body in situ by burning carbonaceous residue adjacent the lower end of the body while introducing oxygen into the combustion front from adjacent the lower end of the body;

volatilizing hydrocarbonaceous product with thermal energy from the combustion front producing a body of hot shale, a first lower molecular weight fraction and a higher molecular weight fraction;

refluxing the higher molecular weight fraction to produce a second lower molecular weight fraction and said carbonaceous residue by condensing the higher molecular weight fraction thereby forming a condensate and by flowing said condensate downwardly into contact with said body of hot shale, said oxygen being introduced so as to allow condensation and downward flow of said higher molecular weight fraction in the refluxing step; and producing a carbonaceous residue on said body of hot shale by cracking the higher molecular weight fraction with thermal energy from the combustion front producing said second lower molecular weight fraction and said carbonaceous residue.

10. The process defined in claim 9 wherein the forming step further comprises controlling the temperature of the combustion front by regulating the amount of oxygen available to the combustion front.

11. The process defined in claim 9 wherein the process further comprises sweeping the first and second lower molecular weight fractions from the body of rubblized oil shale by passing a noncombustible gas upwardly through said body of rubblized oil shale so as to sweep away said first and second lower molecular weight fractions while allowing condensation and downward flow of said higher molecular weight fraction in said refluxing step.

12. The process defined in claim 11 wherein the sweeping step further comprises recycling at least a portion of the combustion gases produced in the combustion front as the noncombustible gas.

13. The process defined in claim 11 wherein said sweeping step comprises directing a water vapor upwardly through said body.

14. The process defined in claim 13 wherein said directing step comprises enriching the volatilized, hydrocarbonaceous product with hydrogen by cracking at least a portion of the water vapor with the carbonaceous residue in the combustion front thereby producing hydrogen and an oxide of carbon.

15. The process defined in claim 13 wherein the directing step comprises concentrating the first and second lower molecular weight fractions by condensing water vapor therefrom.

16. The process defined in claim 11 wherein the sweeping step further comprises diluting the oxygen to the combustion front with the noncombustible gas thereby further controlling the temperature of the combustion front.

17. The process defined in claim 9 wherein the refluxing step further comprises preheating the body above the combustion front by passing the first and second lower molecular weight fractions through the body and condensing the higher molecular weight fraction in the body, the preheating producing a thermal breakdown of kerogen in the body in advance of the combustion front.

18. A process for recovering hydrocarbon products from a body of fragmented oil shale in situ, comprising:

initiating a combustion front in situ adjacent the lower end of the body;

controlling the temperature of the combustion front by regulating the flow of oxygen to the combustion front;

volatilizing hydrocarbons in the oil shale with thermal energy from the combustion front thereby producing a body of hot shale, a first lower molecular weight fraction and a higher molecular weight fraction;

refluxing the higher molecular weight fraction by condensing at least a portion of the higher molecular weight fraction forming a condensate and by flowing said condensate downwardly into contact with said body of hot shale, said oxygen flow allowing condensation and downward flow of said higher molecular weight fraction in the refluxing step;

thermally cracking at least a portion of said condensate producing a second lower molecular weight fraction and a carbonaceous residue, said second lower molecular weight fraction volatilizing and passing upwardly through said body;

recovering said first and second lower molecular weight fractions; and maintaining said combustion front by burning the carbonaceous residue, thereby advancing said combustion front upwardly through said body.

* * * * *